US005373714A

United States Patent [19]

Wada

[11] Patent Number: 5,373,714

[45] Date of Patent: Dec. 20, 1994

[54] CONTROL DEVICE FOR WASHING MACHINES

[75] Inventor: Masatsugu Wada, Seto, Japan

[73] Assignee: Kabushiki Kaisha Toshiba, Kanagawa, Japan

[21] Appl. No.: 139,536

[22] Filed: Oct. 20, 1993

[30] Foreign Application Priority Data

Oct. 20, 1992 [JP] Japan ..... 4-281526

[51] Int. Cl.[5] ..... D06F 33/02

[52] U.S. Cl. ..... 68/12.02; 68/12.19

[58] Field of Search ..... 68/12.02, 12.16, 12.19, 68/12.05

[56] References Cited

U.S. PATENT DOCUMENTS

| | | | |
|---|---|---|---|
| 4,222,250 | 9/1980 | Torita | 68/12.02 |
| 4,653,294 | 3/1987 | Akimaga | 68/12 R |
| 5,048,139 | 9/1991 | Matsumi et al. | 8/158 |
| 5,230,227 | 7/1993 | Kondoh et al. | 68/12.02 |

FOREIGN PATENT DOCUMENTS

| | | | |
|---|---|---|---|
| 59-115095 | 7/1984 | Japan | 68/12.02 |
| 62-226689 | 1/1987 | Japan | 68/12.02 |
| 2-6558 | 2/1990 | Japan | 68/12.02 |

OTHER PUBLICATIONS

WPI Abstract Accession No. 91-321471/44 and JP 3215293 (Matsushita) Sep. 20, 1991 (see abstract).

*Primary Examiner*—Frankie L. Stinson

*Attorney, Agent, or Firm*—Limbach & Limbach

[57] ABSTRACT

In a control device for an automatic washing machine, a first change in the turbidity of a wash liquid is detected a predetermined time period after start of a wash step. The predetermined time period corresponds to a time period required for the detergent to sufficiently dissolve into the water. A time period of the wash step is determined on the basis of the detected change of turbidity. The wash step is completed upon lapse of the determined time period when a second change in the turbidity of the wash liquid in a short period upon lapse of the wash step time period is at a predetermined value or below. When the turbidity change is above the predetermined value, the wash step time period is extended by a period of time in accordance with the first change in the turbidity.

8 Claims, 6 Drawing Sheets

CONTROL DEVICE FOR WASHING MACHINES

BACKGROUND OF THE INVENTION

1. Field of the Invention

This invention relates to a control device for a washing machine, detecting the turbidity of a wash liquid contained in a wash tub and automatically determining a period of time of a wash step on the basis of the detected turbidity.

2. Description of the Prior Art

A microcomputer-based control device has recently been incorporated in washing machines. The microcomputer determines a rate of change of the turbidity on the basis of a turbidity detection signal generated by a turbidity sensor provided for detecting the turbidity of a wash liquid in a wash step. Based on the result of determination about the rate of change of the turbidity, the microcomputer automatically sets a period of time of the wash step. The prior art has provided two methods regarding the above-described control: in one method, the wash step time period is determined mainly in accordance with the concentration of a used detergent, while it is determined mainly in accordance with the degree of soil of the clothes in the other method. The detected turbidity is used as information of concentration of the detergent in the former method while it is used as information of degree of soil of the clothes in the latter.

Generally, the detergent concentration at an initial stage of the wash step depends upon a dissolving or dispersing rate of the detergent, which rate further depends upon a speed at which the wash liquid is agitated, that is, the movability of the clothes in the wash tub. Particularly, in the above-described latter arrangement wherein the time period of the wash step determined mainly in accordance with the detergent concentration, the detergent concentration is not uniform in the wash tub or it takes different values depending upon a volume of the clothes or the cloth quality. Consequently, the time period of the wash step determined in accordance with the detected turbidity of the wash liquid varies widely, which reduces the reliability of the determined time period of the wash step.

Furthermore, the cleaning action of the detergent or the wash liquid is maintained yet while the turbidity is actually changing even upon lapse of the set wash step time period. In this case, it would be better to extend the period of the washing operation. However, this has been ignored in the prior art.

SUMMARY OF THE INVENTION

Therefore, an object of the present invention is to provide a control device for a washing machine wherein a reliable time period of the wash step can be automatically set on the basis of the detected turbidity of the wash liquid.

Another object of the invention is to provide a control device for a washing machine wherein the time period of the wash step can be automatically extended even after lapse of the automatically set time period of the wash step when the extension of the time period of the wash step is effective.

To achieve these and other objects, the present invention provides a control device for a washing machine, comprising agitation means for agitating a detergent, clothes and wash liquid contained in a wash tub of the washing machine, wash step execution means for executing a washing operation wherein the wash liquid is agitated in the wash tub during execution of a wash step elapses, first turbidity change detection means for detecting a difference between the turbidity of the wash liquid at a preselected time and the turbidity a predetermined period of time after the preselected time, the predetermined time period being previously determined to correspond to a time period required for dissolution or dispersion of the detergent by the agitation means, wash step time period setting means for setting a period of time required for the wash step on the basis of the difference of the turbidity obtained by the first turbidity change detection means, second turbidity change detection means for detecting a rate of change of the turbidity of the wash liquid upon lapse of the time period set by the wash step time period setting means, determination means for determining whether the rate of change of the turbidity detected by the second turbidity change detection means has exceeded a threshold value or not, and extension time period setting means for setting an extension time period added to the wash step time period set by the wash step time period setting means when the determination means determines in the affirmative.

The first turbidity change detecting means detects the turbidity change rate for the determination of detergent concentration or the difference between the turbidity at the preselected time and the turbidity after the detergent, clothes and wash liquid are agitated for the predetermined period of time starting from the preselected time. The predetermined time period is previously determined to correspond to a time period required for dissolution or dispersion of the detergent by the agitation means. Accordingly, the turbidity detected as described above reflects the state of the detergent well dissolved into or well dispersed in the wash liquid in the wash tub. Furthermore, the detected turbidity has not been influenced by the volume of clothes or cloth quality affecting the solubility or dispersiveness of the detergent, that is, the speed at which the clothes are agitated. Consequently, the wash step period of time set as described above is highly reliable.

Additionally, the second turbidity change detection means detects the rate of change of the turbidity of the wash liquid upon lapse of the time period set by the wash step time period setting means. The extension time period setting means sets the extension time period added to the wash step time period set by the wash step time period setting means when the turbidity change rate detected by the second turbidity change detection means is at the threshold value or above, that is, when the cleaning action of the detergent or the wash liquid is maintained yet while the turbidity is actually changing even upon lapse of the set wash step time period. Consequently, redundant washing operation can be prevented and insufficiency in the cleaning action can be resolved.

In a preferred form, the control device further comprises means for automatically setting a standard wash step period of time in response to an operation for starting the wash operation and means for adding a compensation period of time to or subtracting the same from the standard wash step time period so that the wash step time period set by the wash step time period setting means is obtained, the compensation time period being previously determined in accordance with the difference of the turbidity detected by the first turbidity change detection means.

In another preferred form, the extension time period set by the extension time period setting means takes a value previously determined in accordance with the difference in the turbidity detected by the first turbidity change detecting means.

In further another preferred form, the control device further comprises water level setting means for setting a water level in the wash tub, load detecting means for detecting an amount of the clothes in the wash tub and cloth quality detecting means for detecting the cloth quality of the clothes and wherein the water level setting means sets a first water level in accordance with the volume of load detected by the load detecting means and subsequently, sets a compensation amount of water in accordance with the cloth quality detected by the cloth quality detecting means, thereby obtaining an operation water level by adding the compensation amount of water to the first water level.

In yet another preferred form, each of the first and second turbidity change detecting means comprises a light emitting element emitting light into the wash liquid and a light detecting element- detecting the light emitted by the light emitting element to thereby generate an electrical signal in accordance with transmittance of the light emitted into the wash liquid.

Other objects of the present invention will become obvious upon understanding of the illustrative embodiment about to be described. Various advantages not referred to herein will occur to those skilled in the art upon employment of the invention in practice.

BRIEF DESCRIPTION OF THE DRAWINGS

An embodiment of the present invention will be described with reference to the accompanying drawings, in which.

DESCRIPTION OF THE PREFERRED EMBODIMENT

Figure 1:
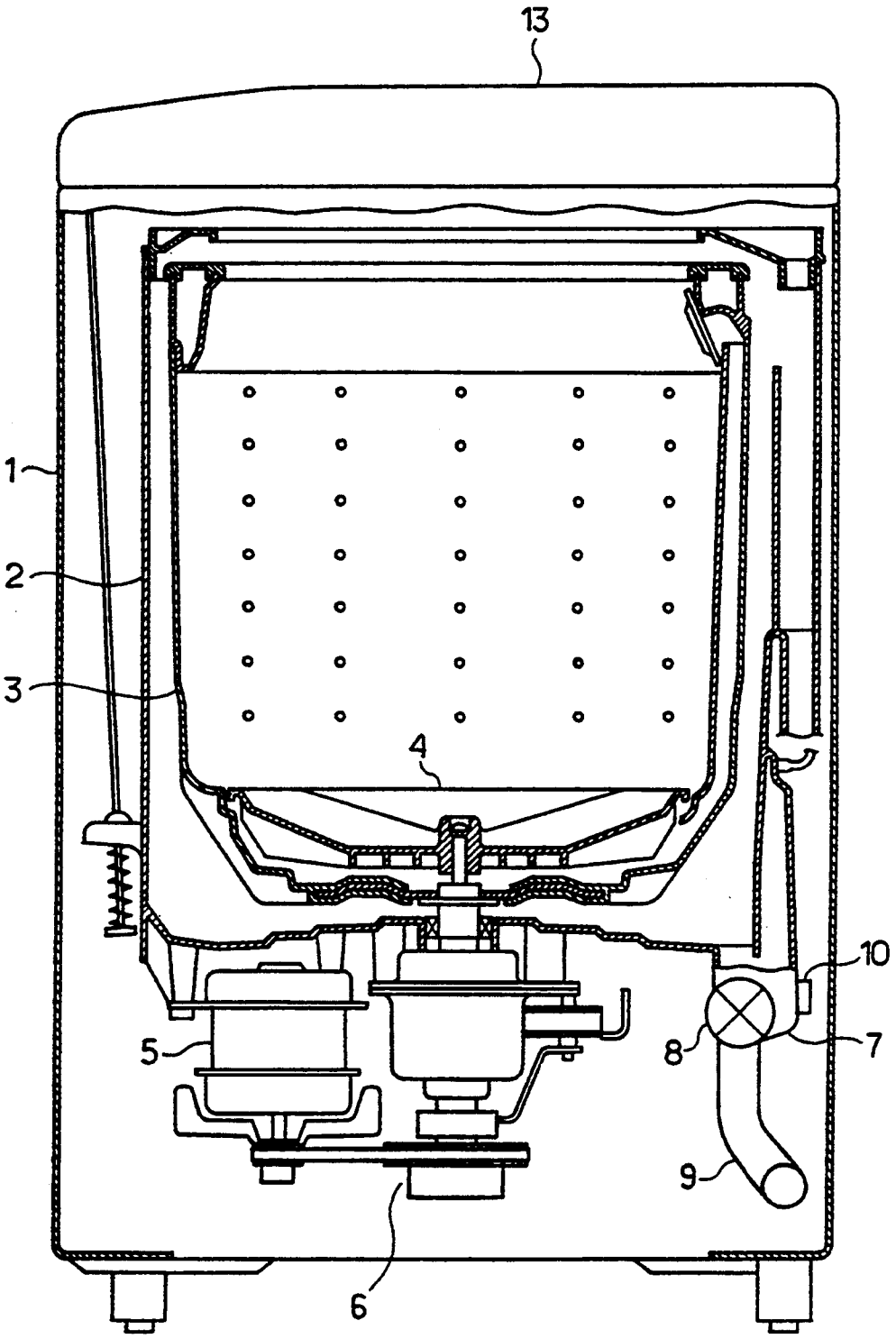
FIG. 1 is a partially unbroken, longitudinally sectional side view of a washing machine incorporated with a control device of an embodiment of the present invention.

The embodiment of the present invention will now be described with reference to the drawings. Referring to FIG. 1, there is shown an automatic washing machine incorporated with the control device in accordance with the invention. An outer cabinet 1 of the washing machine encloses a water-receiving tub 2 elastically suspended therein. A wash tub 3 serving both for wash and for dehydration is rotatably mounted in the water-receiving tub 2. An agitator 4 is rotatably mounted on the inner bottom of the wash tub 3.

A drive mechanism 6 including an electric motor 5 is provided beneath the water-receiving tub 2. The agitator 4 is driven by the drive mechanism 6 in a wash step. The wash tub 3 is rotated at a high speed by the drive mechanism 6 in a dehydration step. A drain case 7, a drain valve 8 and a drain hose 9 are also provided beneath the water-receiving tub 2 for the purpose of discharging the wash liquid from the water-receiving tub 2 outside the machine. A turbidity sensor 10 is mounted in the drain case 7 for detecting the turbidity of the wash liquid in the water-receiving tub 2.

Figure 2:
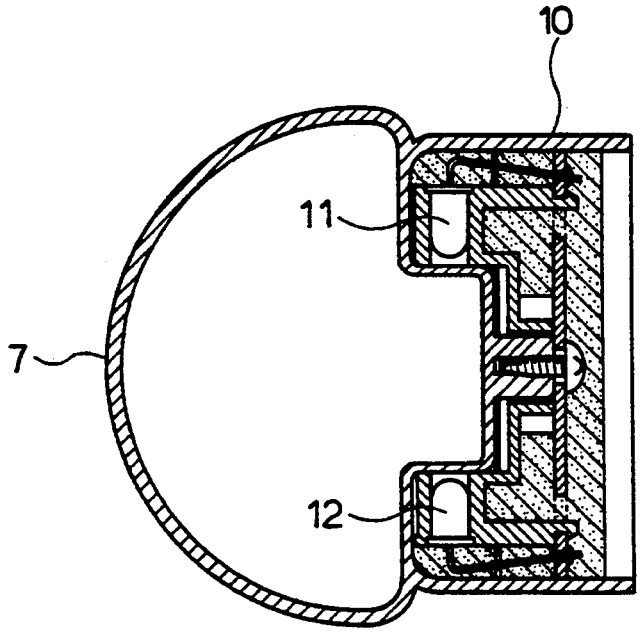
FIG. 2 is an enlarged sectional view of a turbidity sensor employed in the washing machine.
Figure 3:
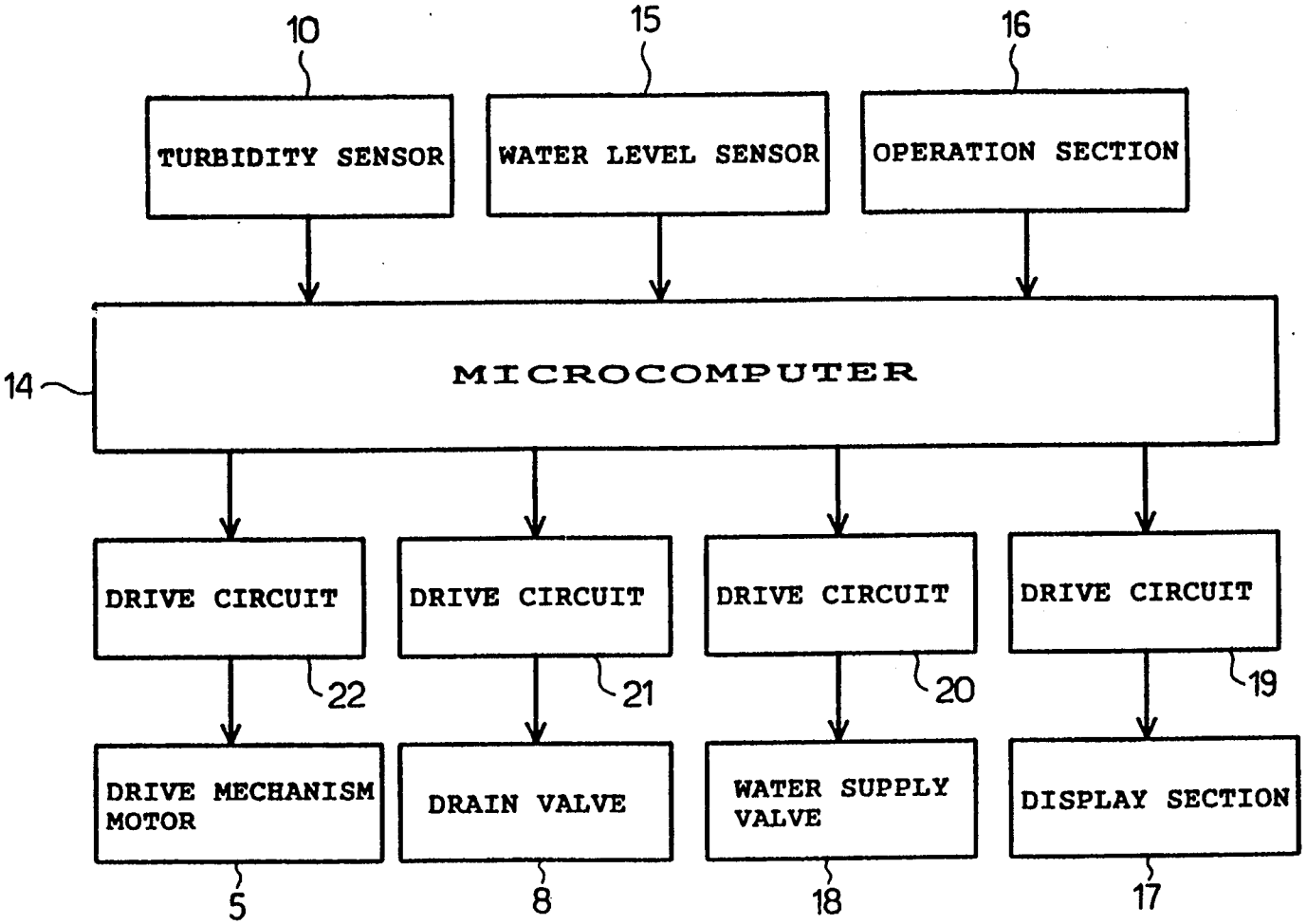
FIG. 3 is a block diagram showing an electrical arrangement of the washing machine.

Referring to FIG. 2, the turbidity sensor 10 comprises a light emitting element 11 and a light detecting element 12 disposed opposite each other. The light emitting element 11 emits light into the wash liquid flowing into the drain case 7 from the water-receiving tub 2. The light detecting element 12 detects the light passing through the wash liquid in the drain case 7, thereby generating a turbidity detection signal. The level of the turbidity detection signal becomes lower as the turbidity of the wash liquid is increased.

A top cover 13 is mounted on the top of the outer cabinet 1. A microcomputer 14 is provided inside the top cover 13. The microcomputer 14 serves as turbidity change detecting means for detecting changes in the turbidity of the wash liquid in association with the turbidity sensor 10, as wash step time period setting means for setting a period of time of a wash step on the basis of the result of the turbidity detection, and as control means for providing control of the wash step and extension of the time period of the wash step, as will be described later. The microcomputer 14 is supplied with the turbidity detection signal from the turbidity sensor 10 and with a water level detection signal from a water level sensor 15 provided for sensing the water level in the water-receiving tub 2. Furthermore, various operation signals are supplied to the microcomputer 14 from an operation section 16 including various operation switches mounted in an operation panel (not shown). Based on these input signals and a previously stored control program, the microcomputer 14 supplies drive control signals to drive circuits 19 to 22 driving a display section 17 including various displays provided in the operation panel, a water supply valve 18 for supplying water into the wash tub 3, the drain valve 8, and the motor 5 of the drive mechanism 6 respectively.

Figure 4:
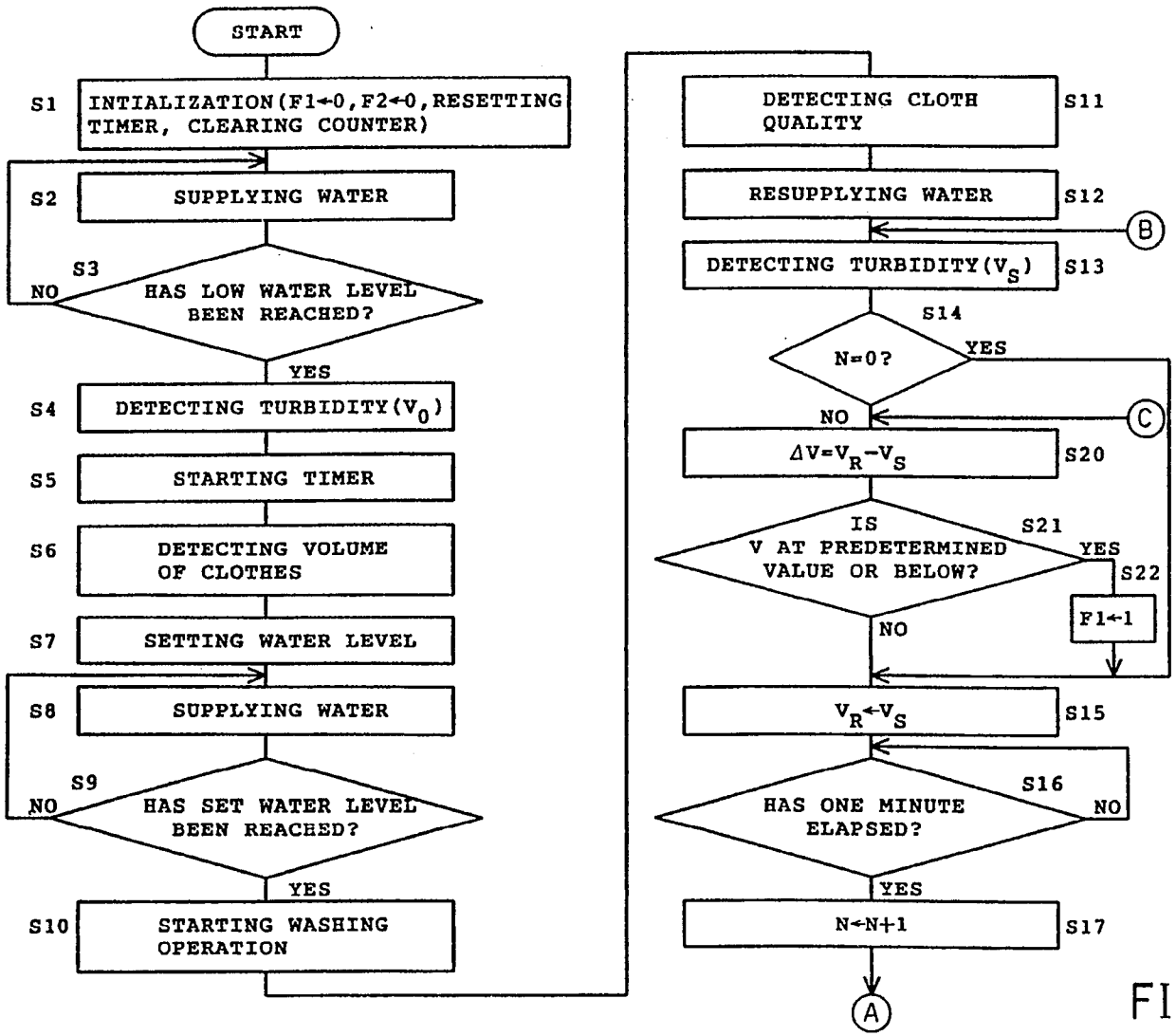
FIG. 4 is a flowchart explaining the first half of the wash step.

The operation of the washing machine will be described with the functions of the microcomputer 14. Upon operation of a START switch (not shown), the microcomputer 14 starts its operation for the washing as shown in FIG. 4. At first, the microcomputer 14 initializes flags F1 and F2, a timer, a counter (none of them being shown) and the like at step S1. Then, the water supply valve 18 is opened so that the water supply into the wash tub 3 is initiated, at step S2. The water supply into the wash tub 3 is continued until the microcomputer 14 determines that the water level in the water-receiving tub 2 has reached a previously determined low level, on the basis of the water level detection signals generated by the water level sensor 15, at step S3.

Figure 6:
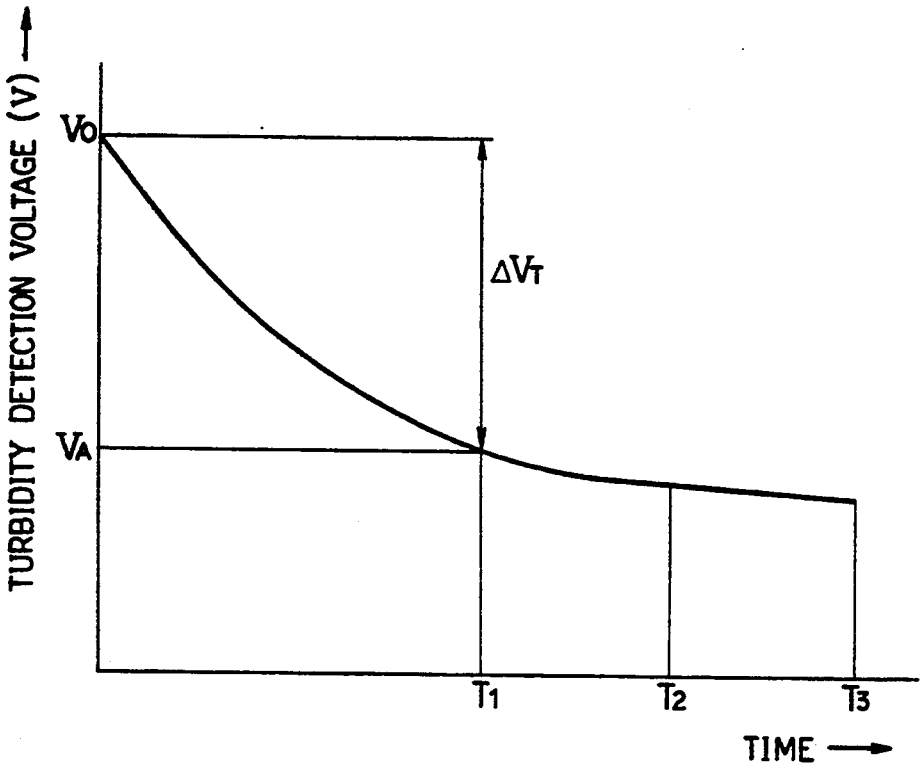
FIG. 6 is a graph showing the change in turbidity of the wash liquid.

Subsequently, the microcomputer 14 detects the turbidity of the wash liquid in the wash tub 3 on the basis of the turbidity detection signals from the turbidity sensor 10, at step S4. As shown in FIG. 6, the turbidity detection signal or voltage V takes an initial value $V_0$ immediately when the water has reached the low water level.

The microcomputer 14 then starts the timer for monitoring the wash step time period, at step S5. A volume of clothes to be washed is then detected at step S6. In detection of the volume of clothes, an amount of load applied to the motor 5 is detected when the agitator 4 is rotated in the low water level condition. For this purpose, a current flowing into the motor 5, the phase difference between the current and an applied voltage, or a speed of the motor 5 is detected in a manner as well known in the art.

Based on the volume of clothes detected as described above, the microcomputer 14 sets the water level in accordance with the volume of clothes, at step S7. At the same time, a standard wash step time period is set at a predetermined value in accordance with the set water level as shown in the following TABLE 1:

TABLE 1

| Set water level | Standard wash step time period (minute) |
|---|---|
| Low | 9 |
| Middle | 10 |
| High | 12 |

Subsequently, the water supply is restarted at step S8 and it is continued when the microcomputer 14 determines that the set water level has been reached, on the basis of the water level detection signal from the water level sensor 15, at step S9.

Then, the control advances to the wash step wherein the washing operation is initiated by rotation of the agitator 4 in a predetermined rotational pattern, at step S10. The cloth quality of the clothes is detected upon initiation of the wash step at step S11. The cloth quality detection is based on the degree of variation in the speed of the motor 5 when the agitator 4 is rotated in the forward and reverse directions in the condition that the set water level has been reached. The degree of variation in the motor speed becomes higher as the cloth quality is hard. Accordingly, the cloth quality can be determined by detecting the degree of variation in the motor speed as described above.

After detection of the cloth quality, an amount of water in accordance with the cloth quality is resupplied at step S12. Thereafter, the microcomputer 14 again detects the turbidity of the wash liquid in the wash tub 3 on the basis of the detection signal or voltage $V_S$ from the turbidity sensor 10 at step S13.

The microcomputer 14 then determines whether the count value N of a counter (not shown) is 0 or not, at step S14. Since it is determined at this stage that the count value N is 0, a voltage $V_R$ is substituted for the detected voltage $V_S$ and the data of the voltage $V_R$ is stored at step S15. Subsequently, the microcomputer 14 determines at step S16 whether one minute has elapsed or not. When it is determined that one minute has elapsed, the value (N+1) is written into a memory (not shown) for the count value N of the counter, at step S17.

Figure 5:
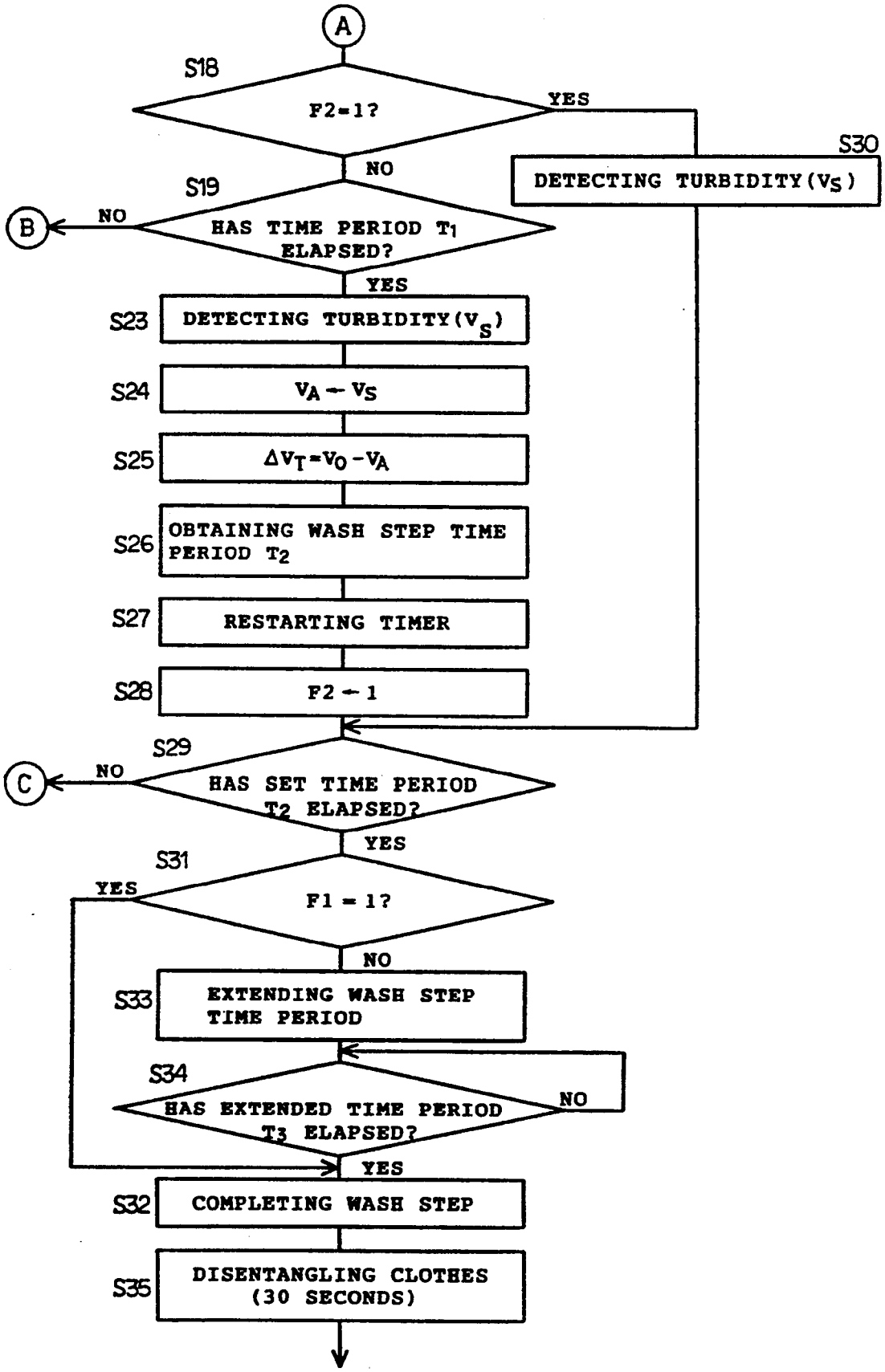
FIG. 5 is a flowchart explaining the latter half of the wash step.

The microcomputer 14 then determines at step S18 whether the value of the flag F2 is 1 or not, as shown in FIG. 5. Since the microcomputer 14 determines at this stage that the value of the flag F2 is not 1, it determines at step S19 whether a predetermined time period $T_1$ (six minutes from the start of the wash step, for example) has elapsed or not. The time period $T_1$ corresponds to a time period required for a powdered detergent to dissolve sufficiently into the wash water such that the concentration becomes uniform. The microcomputer 14 returns to step S13 when determining that the time period $T_1$ has not elapsed. At step S13, the microcomputer 14 detects the turbidity of the wash liquid in the wash tub 3 on the basis of the detection signal or voltage $V_S$ from the turbidity sensor 10, as described above.

Subsequently, at step S14, the microcomputer 14 determines that the count value N of the counter is not 0, since the value (N+1) is has been written into the memory at step S17. The microcomputer 14 then subtracts the current turbidity detection voltage $V_S$ from the turbidity detection voltage $V_R$ one minute before, thereby obtaining the difference $\Delta V$ or a rate of change of the turbidity of the wash liquid (step S20). The microcomputer 14 then determines whether or not the difference $\Delta V$ is at a predetermined value $V_a$, for example, 0.05 V, or below, at step S21, at which predetermined value $V_a$ the wash step is terminated. The change rate $\Delta V$ of turbidity is compared with a predetermined value $V_a$ for the purpose of determination of a degree of maintenance of the cleaning action, as will be described later. When determining in the negative at step S21, the microcomputer 14 advances to step S15. When determining in the affirmative at step S21, the microcomputer 14 sets the value of the flag F1 at 1 at step S22 and then advances to step S15.

The microcomputer 14 repeats the above-described steps until it determines at step S19 that the predetermined time period $T_1$ has elapsed, thereby obtaining the turbidity change rate $\Delta V$ every one minute and determining whether or not the change rate is at the predetermined value $V_a$ or below.

On the other hand, when it is determined at step S19 that the predetermined time period $T_1$ has elapsed, the turbidity sensor 10 generates the turbidity detection signal or voltage $V_S$, at step S23. Then, the voltage $V_S$ is substituted for the voltage $V_A$ (see FIG. 6) to be stored in it, at step S24. Thereafter, the microcomputer 14 subtracts the current turbidity detection voltage $V_S$ ($V_A$) from the turbidity detection signal $V_0$ (initial value) generated at step S4, thereby obtaining the difference $\Delta V_T$ or a rate of change of the turbidity of the wash liquid for the time period $T_1$ (step S25). The obtained difference $\Delta V_T$ serves as a turbidity change rate for determination of the detergent concentration. The value of the difference $\Delta V_T$ depends upon the concentration of the detergent dissolved into the wash liquid rather than upon an amount of soil removed from the clothes. Accordingly, it is beneficial to automatically determine a wash step time period on the basis of the value of the difference $\Delta V_T$. The microcomputer 14 determines the wash step time period $T_2$ on the basis of the difference $\Delta V_T$, The standard wash time period set previously is compensated so that the wash step time period is obtained (step S26). The following TABLE 2 shows compensation time periods added to or subtracted from the standard wash time periods set at step S7.

TABLE 2

| $\Delta V_T$ (V) | Type and concentration of detergent | Compensation time period (minute) | Extended wash step time period (minute) |
|---|---|---|---|
| $0 < \Delta V_T \leqq 0.8$ | Liquid detergent | +4 | +4 |
| $0.8 < \Delta V_T \leqq 1.4$ | Synthetic detergent Concentration: 0.5 | +2 | +4 |
| $1.4 < \Delta V_T \leqq 1.9$ | Synthetic detergent Concentration: 1.0 | ±0 | +3 |
| $1.9 < \Delta V_T$ | Synthetic detergent Concentration: 1.5 | −2 | +2 |

The detergent is determined to be a liquid detergent and its concentration to be 1.0 where $1.4 < \Delta V_T \leqq 1.9$. In this case, the compensation time period is then set at ±0. The detergent is determined to be a synthetic detergent and its concentration to be 0.5 where $0.8<\Delta V_T \leqq 1.4$. In this case, two minutes are added to the standard wash time period. The detergent is determined to be a liquid detergent where $0<\Delta V_T \leqq 0.8$. In this case, four minutes are added to the standard wash time period. Furthermore, the detergent is determined to be a synthetic detergent and its concentration to be 1.5 where $1.9<\Delta V_T$. In this case, two minutes are subtracted from the standard wash time period.

The microcomputer 14 restarts the timer for monitoring the wash step time period, at step S27 and sets the flag F2 at 1 at step S28. The microcomputer 14 then determines whether the compensated wash time period $T_2$ has elapsed or not, at step S29. The microcomputer 14 returns to step S20 when determining that the period $T_2$ has not elapsed. After returning to step S20, the microcomputer 14 operates in the same manner as described above until it advances to step S18. The microcomputer 14 determines at step S18 that the flag F2 is set at 1, on the basis of the result at step S28. Then, the microcomputer 14 advances to step S30 where the turbidity of the wash liquid is determined on the basis of the detection signal or voltage $V_S$ generated by the turbidity sensor 10. Thereafter, until the microcomputer 14 determines at step S29 that the set time period $T_2$ has elapsed, it repeats the above-described steps to obtain the change rate (difference $\Delta V$) in the turbidity of the wash liquid and to determine whether or not the obtained difference $\Delta V$ is at the predetermined value $V_a$ or below, that is, the degree of progress of cleaning action. When the change rate of the turbidity is relatively large after lapse of the time period $T_2$, removal of soil from the clothes is going on. This signifies that the cleaning action is effectively in progress. On the other hand, when the change rate of the turbidity is extremely small, the degree of removal of soil from the clothes is extremely small. Accordingly, the cleaning action is not almost maintained, which means that further execution of the wash step is useless.

When determining at step S29 that the set time period $T_2$ has elapsed, the microcomputer 14 advances to step S31 where it determines whether the flag F1 is set at 1 or not. The wash step is completed when it is determined that the flag F1 is set at 1 or that the difference $\Delta V$ is at the predetermined value $V_a$ or below (step S32).

When it is not determined at step S31 that the flag F1 is set at 1 or it is determined that the difference $\Delta V$ is above the predetermined value $V_a$, the degree of progress of the cleaning action is high and accordingly, extension of the wash time period is beneficial. In this case, the wash time period is extended by the time period in accordance with the value of the difference $\Delta V_T$ (step S33).

The right-hand column of TABLE 2 shows extended wash step time periods set as described above. Two minutes are added to the set time period $T_2$ where $1.9<\Delta V_T$. Three minutes are added to the period $T_2$ where $1.4<\Delta V_T \leqq 1.9$. Four minutes are added to the period $T_2$ both where $0.8<\Delta V_T \leqq 1.4$ and where $0<\Delta V_T \leqq 0.8$. Subsequently, the microcomputer 14 determines at step S34 whether the extended wash time period $T_3$ has elapsed or not. When determining that the period has elapsed, the microcomputer 14 advances to step S32 where the wash step is completed. Upon completion of the wash step, the agitator 4 is rotated for a predetermined period of time (30 seconds, for example) in the forward and reverse directions at a speed lower and at intervals shorter than in the previous wash step, so that the clothes entangled in the wash step are disentangled (step S35). The microcomputer 14 then advances to a subsequent step (not shown).

According to the above-described embodiment, the change in the turbidity of the wash liquid is detected not only at the initial stage of the wash step but also after lapse of the predetermined time period which is required for the turbidity of the wash liquid to become uniform in the wash tub 3, for example, six minutes. In this while, the clothes and the detergent are agitated sufficiently so that the concentration of the detergent does not vary widely to be stabilized. Consequently, the amount of detergent can be accurately determined and accordingly, the wash step time period can be accurately set.

Furthermore, the wash step time period can be extended up to the period $T_3$ in accordance with the result of detection of the turbidity change at the time of determination of detergent concentration, where the turbidity difference $\Delta V$ is not at the predetermined value $V_a$ or below upon lapse of the time period $T_2$ automatically set in accordance with the turbidity of the wash liquid. Consequently, when the cleaning action is still maintained even upon lapse of the previously set wash step time period $T_2$, the washing operation can be continuously performed so that the soil can be removed from the clothes.

The foregoing disclosure and drawings are merely illustrative of the present invention and are not to be interpreted in a limiting sense. The only limitation is to be determined from a scope of the appended claims.

I claim:

1. A control device for a washing machine, comprising:

a) agitation means for agitating a detergent, clothes and wash liquid contained in a wash tub of the washing machine;

b) wash step execution means for executing a washing operation wherein the wash liquid is agitated in the wash tub during execution of a wash step elapses;

c) first turbidity change detection means for detecting a difference between the turbidity of the wash liquid at a preselected time and the turbidity a predetermined period of time after the preselected time, the predetermined time period being previously determined to correspond to a time period required for dissolution or dispersion of the detergent by the agitation means;

d) wash step time period setting means for setting a period of time required for the wash step on the basis of the difference of the turbidity obtained by the first turbidity change detection means;

e) second turbidity change detection means for detecting a rate of change of the turbidity of the wash liquid upon lapse of the time period set by the wash step time period setting means;

f) determination means for determining whether the rate of change of the turbidity detected by the second turbidity change detection means has exceeded a threshold value or not; and g ) extension time period setting means for setting an extension time period added to the wash step time period set by the wash step time period setting means when the determination means determines in the affirmative.

2. A control device according to claim 1, further comprising means for automatically setting a standard wash step execution period of time in response to an operation for starting the wash operation and means for adding a compensation period of time to or subtracting the same from the standard wash step time period so that the wash step time period set by the wash step time period setting means is obtained, the compensation time period being previously determined in accordance with the difference of the turbidity detected by the first turbidity change detection means.

3. A control device according to claim 2, wherein the extension time period set by the extension time period setting means takes a value previously determined in accordance with the difference in the turbidity detected by the first turbidity change detecting means.

4. A control device according to claim 3, wherein the control device has data of a plurality of values of the difference in the turbidity of the wash liquid, data of a plurality of the compensation time periods, and data of a plurality of the extension time periods, the values of the difference in the turbidity corresponding to the respective compensation time periods and the respective extension time periods.

5. A control device according to claim 1, further comprising water level setting means for setting a water level in the wash tub, standard time period setting means for setting a standard wash step period of time in accordance with the water level set by the water level setting means, and means for adding a compensation period of time to or subtracting the same from the standard wash step time period so that the wash step time period set by the wash step time period setting means is obtained, the compensation time period being previously determined in accordance with the difference of the turbidity detected by the first turbidity change detection means.

6. A control device according to claim 5, further comprising load detecting means for detecting an amount of the clothes in the wash tub and cloth quality detecting means for detecting the cloth quality of the clothes and wherein the water level setting means sets a first water level in accordance with the amount of load detected by the load detecting means and subsequently, sets a compensation amount of water in accordance with the cloth quality detected by the cloth quality detecting means, thereby obtaining an operation water level by adding the compensation amount of water to the first water level.

7. A control device according to claim 1, wherein the extension time period set by the extension time period setting means takes a value previously determined in accordance with the difference in the turbidity detected by the first turbidity change detecting means.

8. A control device according to claim 1, wherein each of the first and second turbidity change detecting means comprises a light emitting element emitting light into the wash liquid and a light detecting element detecting the light emitted into the wash liquid by the light emitting element to thereby generate an electrical signal in accordance with transmittance of the light emitted into the wash liquid.

* * * * *